US008089000B2

(12) United States Patent
Van Der Meer

(10) Patent No.: US 8,089,000 B2
(45) Date of Patent: Jan. 3, 2012

(54) WATERPROOF DATA CABLE WITH FOAM FILLER AND WATER BLOCKING MATERIAL

(75) Inventor: Harry Van Der Meer, Uxbridge, MA (US)

(73) Assignee: General Cable Technologies Corporation, Highland Heights, KY (US)

( * ) Notice: Subject to any disclaimer, the term of this patent is extended or adjusted under 35 U.S.C. 154(b) by 297 days.

(21) Appl. No.: 12/247,734

(22) Filed: Oct. 8, 2008

(65) Prior Publication Data

US 2009/0194315 A1 Aug. 6, 2009

Related U.S. Application Data

(60) Provisional application No. 60/979,411, filed on Oct. 12, 2007.

(51) Int. Cl.
*H01B 7/00* (2006.01)

(52) U.S. Cl. ..... 174/110 R; 174/113 R; 174/113 C; 174/116

(58) Field of Classification Search ..... 174/110 R, 174/113 R, 115, 116, 120 R, 120 SC, 110 N, 174/110 D, 121 R, 121 A
See application file for complete search history.

(56) References Cited

U.S. PATENT DOCUMENTS

| | | | | |
|---|---|---|---|---|
| 3,775,548 | A * | 11/1973 | Zinser et al. | 174/23 C |
| 3,843,568 | A * | 10/1974 | Woodland et al. | 521/54 |
| 4,145,567 | A * | 3/1979 | Bahder et al. | 174/107 |
| 4,333,706 | A * | 6/1982 | Davis et al. | 385/100 |
| 5,010,209 | A * | 4/1991 | Marciano-Agostinelli et al. | 174/23 C |
| 5,138,685 | A | 8/1992 | Arroyo et al. | |
| 5,448,669 | A | 9/1995 | Dunn et al. | |
| 5,698,615 | A * | 12/1997 | Polle | 523/173 |
| 6,178,277 | B1 | 1/2001 | Ravela et al. | |
| 6,180,721 | B1 * | 1/2001 | Rogestedt et al. | 525/191 |
| 6,184,473 | B1 * | 2/2001 | Reece et al. | 174/110 R |
| 6,455,769 | B1 * | 9/2002 | Belli et al. | 174/23 C |
| 7,048,343 | B2 * | 5/2006 | Peterson et al. | 305/157 |
| 7,049,524 | B2 * | 5/2006 | Belli et al. | 174/120 R |
| 7,750,243 | B1 * | 7/2010 | Mumm et al. | 174/110 R |
| 2002/0053446 | A1 | 5/2002 | Moe et al. | |
| 2003/0178222 | A1 * | 9/2003 | Moore et al. | 174/120 R |

FOREIGN PATENT DOCUMENTS

GB 2 193 594 A * 2/1988

* cited by examiner

*Primary Examiner* — William Mayo, III
(74) *Attorney, Agent, or Firm* — Blank Rome LLP

(57) ABSTRACT

A data cable includes conductors and a filler material substantially surrounding the conductors. The filler material includes a foam filler and a water blocking material. The data cable can also include insulation substantially surrounding each conductor, foam substantially surrounding each conductor, or a solid coating substantially surrounding each conductor The data cable can further include a shielding member substantially surrounding the filler material or a jacket substantially surrounding the filler material.

34 Claims, 2 Drawing Sheets

WATERPROOF DATA CABLE WITH FOAM FILLER AND WATER BLOCKING MATERIAL

CROSS REFERENCE TO RELATED APPLICATION

This application claims priority to U.S. Provisional Patent Application No. 60/979,411, filed Oct. 12, 2007, the disclosure of which is incorporated herein by reference in its entirety.

FIELD OF THE INVENTION

The present invention relates to a data cable. In particular, the present invention relates to a data cable containing foam and water blocking material.

BACKGROUND OF THE INVENTION

Several different types of data cables are in use today. Some data cables utilize optical fibers to transmit light signals, while others use conductors to convey electrical data signals. To minimize potential incompatibility between data cables of the same general type, standards have been established. For conductive data cables, one such standard is known as TIA/EIA-568-B for eight-conductor, 100-ohm, balanced, twisted-pair cabling, such as category 5e conductive data cables. The most identifiable feature of category 5e data cables are their pin/pair assignments. The pin/pair assignment of category 5e cables is often referred to as "eight position eight conductors," ("8P8C") or sometimes referred to as "RJ45." Category 5e conductive data cables are often used in commercial settings where a spectrum of at least 100 MHz is required for data transmission. Typical applications include 10 base T, 100 base TX, token ring, 1000 base T gigabit Ethernet, 155 Mbps ATM, or 622 Mbps ATM.

Depending on the location, to effectively convey data signals from one location to another, a conductive data cable must minimize or prevent moisture inside the data cable since high moisture levels can degrade conductivity and result in loss of data or data distortion. Depending on the construction of the particular data cable, the introduction of moisture can result in a short circuit, an increase in the data cable's capacitance, an increase in signal attenuation, or in the complete failure of the data cable.

Moisture can penetrate to the interior of the data cable in several different ways. Water may enter through a failure in a data cable's jacket. Water may also enter through a cable end, where a cable connector is attached. Mechanical impacts, electrical arcs, or lightning may breach the jacket that protects the data cable or the joint where one data cable joins another. Water may then flow through the breach towards the core of the data cable and longitudinally along the length of the data cable Also, changes in ambient conditions may lead to differences in water vapor pressure between the interior and the exterior of the data cable. The difference in vapor pressure may then cause moisture to diffuse into the interior of the data cable. Eventually, there may be an undesirable level of moisture inside the cable.

Since the data cable's ability to resist penetration by moisture may be a crucial characteristic in certain applications, the data cable must be tested and meet certain performance specifications to ensure that the presence of water will not significantly affect the data cable, Several different performance specifications pertain to waterproof data cables. The particular specification used depends on the proposed application and use. One such specification is MIL-DTL-24643/59, which is set by Naval Sea Systems Command. It prescribes the water blocking requirements for a conductive data cable to be used on a Navy ship. To meet the requirements of MIL-DTL-24643/59, an open end of the data cable is subjected to a predetermined water pressure for a predetermined amount of time. Data cables that allow limited water migration to a specified length when subjected to the test are deemed "waterproof."

Various methods have been used to block water. One method of protecting data cables against water penetration is to provide a layer of plastic or polymeric material. In a cable insulated by a polymeric material, water can travel by capillary action along the cable interstices, causing problems in conductivity. In most environments, it is desirable, if not essential, that the cable be more watertight than can be achieved with polymeric material alone. Some data cables may include a metal/plastic laminate foil beneath the outer protective jacket of the data cable. The metal/plastic laminate foil may become bonded to the polymeric material, normally when the polymer is extruded. However, it is difficult to design a jacket in which the laminate foil remains intact when the data cable is subjected to impact, as the laminate tends to be driven into gaps between conductors lying underneath the laminate and cracks quickly along the resulting crease lines.

Another method of protecting a data cable against water penetration is to use water swellable materials. However, when water swellable materials are exposed to high humidity over a long period of time, they expand by as much as three times their original volume. Associated dielectric properties of water swellable materials, such as dissipation factor and dielectric constant, change as water swellable materials absorb moisture. The water swellable materials are generally in close proximity to the insulated conductors of the data cable. Thus, changes in the dielectric properties of the water swellable materials affect the dielectric properties of conductive data cables, and changes in the dielectric properties of conductive data cables affect their data transmission capabilities. Therefore, when the dielectric properties of the water swellable material changes, the change affects the data transmission capabilities of conductive data cables.

Thus, there is a need in the art for an invention to provide better protection of data cables against water penetration. Particular need remains for water blocking protection that does not change the transmission properties of the data cable. Furthermore, the water blocking protection must allow the cable to meet the requirements of MIL-DTL-24643/59.

SUMMARY OF THE INVENTION

Accordingly, it is an object of the invention to provide protection against water penetration of a data cable that is capable of both blocking water and maintaining transmission properties of the data cable. Another object is to provide a data cable that meets the requirements of the specification MIL-DTL-24643/59.

An exemplary embodiment of the invention provides a data cable. A data cable includes conductors and a filler material substantially surrounding the conductors. The filler material includes a foam filler and a water blocking material.

Another embodiment of the invention provides a data cable. The data cable includes conductors, a foam substantially surrounding each conductor, a solid coating substantially surrounding the foam, and a filler material within which the conductors with the foam and the solid coating are disposed. The filler material includes a foam filler and a water blocking material.

Yet another embodiment of the invention provides a method of manufacturing a data cable. The method includes the steps of providing conductors and disposing the conductors in a filler material with a foam filler and a water blocking material.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
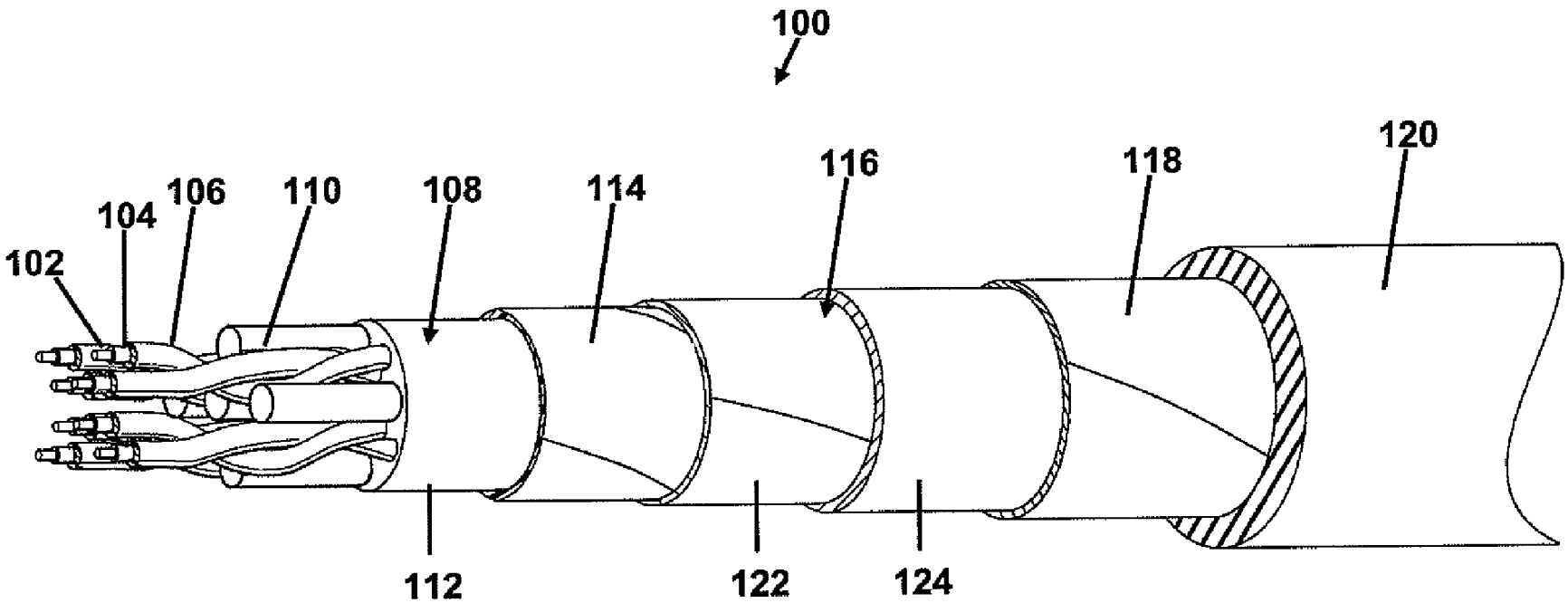
FIG. 1 is a partial perspective view of a data cable according to an exemplary embodiment of the invention, various layers of the cable being exposed for the purposes of illustration.
Figure 2:
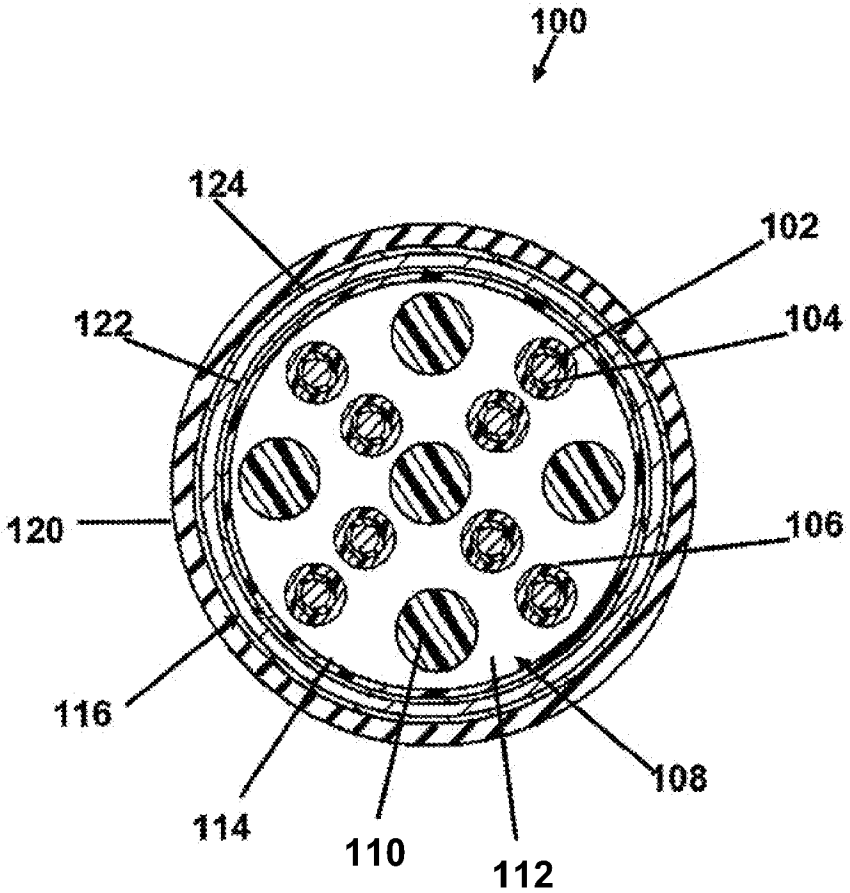
FIG. 2 is a sectional view taken substantially along line 2-2 of the data cable illustrated in FIG. 1.

Referring to FIGS. 1 and 2, the invention relates to a data cable 100 that generally blocks water. The data cable 100 has water blocking protection that includes water swellable materials, but the water swellable materials are isolated and separated from the conductors 102 of the data cable. Because the water swellable materials are isolated and separated from the conductors 102 of the data cable 100, expansion of the water swellable materials does not substantially affect the transmission properties of the data cable 100. Also, the data cable 100 substantially meets or exceeds the requirements of MIL-DTL-24643/59, which specifies the requirements for water blocking cable used aboard Navy ships.

Turning to FIG. 1, a partial perspective view of the data cable 100 according to an embodiment of the invention is shown. The data cable includes, at least, one or more conductors 102, a foam 104 substantially around each of the conductors 102, a solid coat 106 substantially around the foam 104, and a filler material 108 that has a foam filler 110 and a water blocking material 112. In the embodiment of FIG. 1, the conductors 102 with the foam 104 and the solid coat 106 are disposed in the filler material 108. A corewrap 114 is substantially wrapped around the filler material 108, and a shielding member 116 is placed substantially around the corewrap 114. The shielding member 116 is substantially wrapped with water swellable tape 118, and a jacket 120 substantially covers an outermost surface of the data cable 100.

The conductors 102 provide pathways for data signals. For a conductive data cable, the conductors 102 are made of an electrically conductive material such as, but not limited to, copper, aluminum, silver, gold, or some other electrically conductive metal or alloy. The conductors 102 can also be plated with, but not limited to, tin, silver, nickel, or other plating material. Although each of the conductors 102 may be a solid conductor, each of the conductors 102 may alternatively be made up of several conductive strands. The conductors 102 are arranged longitudinally adjacent to one another to form the cable 100 with a substantially circular cross section. Each of the conductors 102 may also be placed longitudinally adjacent to each other to form, for example, a substantially triangular, rectangular, trapezoidal, or polygonal cross section. Also, each of the conductors 102 may be intertwined with each other to form a twisted pair. The conductors 102 may be intertwined in the same direction, or the conductors 102 may be intertwined in a direction different from the intertwining of other conductors. Furthermore, the conductors 102 may be intertwined to form a helical braid or a helical spiral.

The conductors 102 can also be insulated by a dielectric material (not shown) such as, but not limited to, thermoset, thermoplastic polyethylene, polypropylene, thermoplastic fluoropolymer, fluorocarbon-based polymers, polyvinyl chlorides (PVC), polyvinylidene fluoride (PVDF), ethylene tetrafluoroethylene (ETFE), ethylene propylene rubber (EPIC), silicone, silicone tape, rubber tape, glass tape, combinations of the aforementioned materials, or other electrically insulating material. The insulating dielectric material may be colored, coded, marked, or otherwise processed to provide identification. In the embodiment shown, the conductors 102 are insulated by high density polyethylene (HDPE) to provide an outer diameter of approximately 0.042 inches (approximately 1.1 mm)+/−2.5%.

In the embodiment shown, eight conductors 102 are intertwined so as to form four twisted pairs of conductors 102. The conductors 102 are made of copper and are 24 American Wire Gauge ("AWG") per ASTM B8 Class B or have an outer diameter of approximately 0.021 inches (approximately 0.53 mm) nominally. The twisting lay is between approximately one-half inch to approximately one inch. Each pair of conductors 102 are twisted with a different lay length. In other embodiments, the conductors 102 may be made of another material, be of another gauge or AWG, or have a different twisting lay. The number, material, gauge, and twisting lay of the conductors 102 is not meant to be limiting but meant to illustrate one particular embodiment to describe the data cable 100. Referring to FIG. 2, the conductors 102 are arranged longitudinally adjacent to one another to provide the cable 100 with a substantially circular cross-section.

Each conductor 102 is substantially covered with foam 104. The foam 104 provides electrical insulation and water blocking. Bubbles in the foam 104 and the foam 104 itself provide electrical insulation. The foam 104 should be electrically insulating, possess good dielectric properties, and should be extrudable. The foam 104 can be made of, but not limited to, HDPE, propylene, thermoplastic polymer, PVC, fluoropolymer, polytetrafluoroethylene (PTFE), fluorinated ethylene-propylene (FEP), and perfluoroalkoxy polymer resin (PFA). Fluoropolymers include fully fluorinated fluorocarbon polymers and partially fluorinated polymers such as polychlorotrifluoroethylene (PCTFE), ETFE, ethylene chlorotrifluoroethylene (ECTFE), and PVDF. In the embodiment shown, the foam 104 is made of HDPE, and the foam 104 is approximately 6-7 mils thick. The thickness of the foam 104 is exemplary only, and is not intended to be limiting to the invention; the optimal thickness of the foam 104 may be less than 6 mils or more than 7 mils.

The solid coating 106 surrounds the foam 104. The solid coating 106 provides mechanical support for the foam 104. The solid coating 106 can be made of any material that provides rigid support. The solid coating 106 can be made of, for example, HDPE, propylene, thermoplastic polymer, PVC, PTFE, FEP, and PFA. Fluoropolymers include fully fluorinated fluorocarbon polymers and partially fluorinated polymers such as PCTFE, BTFE, ECTFE, and PVDF. In the embodiment shown, the solid coating 106 is made of HDPE, and the solid coating 106 is about 5 mils thick. The thickness of the solid coating 106 is exemplary only, and is not intended to be limiting to the invention; the optimal thickness of the solid coating 106 may be more or less than 5 mils.

The conductors 102, which are substantially surrounded by the foam 104 and the solid coating 106, are disposed within the filler material 108. The filler material 108 is adapted to optimize the transmission properties of the cable 100 and block water. The filler material 108 has dielectric properties substantially similar to dry air and substantially blocks water. The filler material 108 uses "closed cells" that not only maximize air contained within the filler material 108 for good transmission properties but also block water. The filler material 108 can be made of a super absorbent polymer (SAP) and can include a polymer impregnated with SAP.

The filler material 108 includes one or more foam fillers 110 and a water blocking material. The foam filler 110 displaces air pockets that may form within the data cable 100, and the spaces within the data cable 100 that are not filled by the foam filler 110 are substantially filled with the water blocking material. Furthermore, the foam filler 110 occupies a greater portion of the volume within the cable 100 than the water blocking material so that the amount of water blocking material used can be minimized. By minimizing the amount of water blocking material used, the data cable 100 is better able to resist moisture penetration. The foam filler 10 is made from a material that is substantially nonconductive, and because the foam filler 110 is largely nonconductive, the foam filler 110 insulates the data cable 100 and helps to maintain transmission properties when the data cable 100 is exposed to high humidity or submerged in water. Also, unlike water swellable materials, the dielectric properties of the foam filler 110 remain essentially constant when exposed to high humidity or temperature levels. Thus, long periods of exposure to high humidity does not substantially change the dielectric properties of the foam filler 110, and because those dielectric properties are not significantly affected, the foam filler 110 does not appreciably alter the transmission characteristics of the data cable 100 nor cause signal attenuation. In the embodiment shown, the foam filler 110 is made of foam HDPE and has an elongated form that can be cabled with the conductors 102, and the water blocking material is made of polymers, waxes, or oils. Also, in the embodiment shown, the foam filler 110 displaces over 70% of the air within the data cable 100.

The filler material 108 may be substantially surrounded with the corewrap 114. The corewrap 114 provides mechanical support to the filler material 108 while the conductors 102 are disposed within the filler material 108. In the embodiment shown, the corewrap 114 is made of mylar which is helically wrapped with about 25% or greater overlap.

The shielding member 116 surrounds the corewrap 114. The shielding member 116 provides electrical shielding, and the shielding member 116 may be aluminum, aluminum foil, aluminum braid, copper braid, aluminum mylar, combinations of the aforementioned materials, or any other electrically shielding material. In the embodiment shown, the shielding member 116 includes an aluminum/mylar tape 122 helically applied and a copper braid 124. The aluminum/mylar tape 122 is a tape with aluminum on one side and mylar on the other with a coat of water swellable material on the mylar side. The water swellable material on the tape 122 is isolated from the conductors 102 by filler material 108, so that the water swellable material does not substantially affect the transmission properties of the data cable 100. Also, the aluminum/mylar tape 122 has about 25% overlap or greater. The copper braid 124 is made from 36 AWG copper wires with approximately 65% coverage.

Water swellable tape 118 may be placed around the shielding member 116. The water swellable tape 118 generally provides protection against moisture. Because the water swellable tape 118 is disposed outside the shielding member 116, when the water swellable tape 118 expands as it absorbs moisture, the swelling does not affect the transmission properties of the cable 100. The water swellable tape 118 can be made of any soft, fibrous, gauze-like material that can absorb moisture or contains water swellable material. For example, the water swellable tape 118 can be made of a super absorbent polymer tape impregnated with a powder-like water swellable material. The water swellable tape 118 can also be made of super absorbent powder laminated between nonwoven material. In one embodiment, the water swellable tape 118 can be nonwoven laminate with a seawater super absorbent, such as WSM102 manufactured by Scapa.

The jacket 120 wraps the outermost peripheral area of the cable 100. The jacket 120 may be made of a non-conductive material, such as, but not limited to, a polymer or a plastic. The jacket 120 is made of a material that emits little smoke, minor amounts of toxic fumes when the jacket 120 is combusted, and contains substantially no halogens. In the embodiment shown, the jacket 120 is made of a material that meets the standards delineated in MIL-DTL-24643/59, and the jacket 120 is made of fire retardant, halogen free polyolefin with cross link agents. The jacket 120 has a thickness of approximately 0.045 inches (approximately 1.14 mm) and provides an outer diameter of approximately 0.345 inches (approximately 8.76 mm) nominally.

The embodiment of the data cable 100, as described above, meets the standards of MIL-DTL-24643/59. Also, with the above described construction, the data cable 100 has a weight per length of approximately 24.1 kg per 304.8 meters or 53 pounds per 1,000 feet nominally. The data cable 100 also has the following electrical characteristics.

| Frequency | Attenuation (dB/100 m) | | NEXT (dB) | | PSNEXT (dB) | | ACR (dB/100 m) | |
|---|---|---|---|---|---|---|---|---|
| (MHz) | Typical | Maximum | Typical | Minimum | Typical | Minimum | Typical | Minimum |
| 0.772 | 1.5 | 1.8 | 86.3 | 67.0 | 79.9 | 64.0 | 84.8 | 65.2 |
| 1 | 1.7 | 2.0 | 82.3 | 65.3 | 76.0 | 62.3 | 80.6 | 63.3 |
| 4 | 3.5 | 4.1 | 76.5 | 56.3 | 70.1 | 53.3 | 72.9 | 52.2 |
| 8 | 5.0 | 5.8 | 70.9 | 51.8 | 61.4 | 48.8 | 65.9 | 46.0 |
| 10 | 5.7 | 6.5 | 65.7 | 50.3 | 59.7 | 47.3 | 60.1 | 43.8 |
| 16 | 7.2 | 8.2 | 64.6 | 47.3 | 58.1 | 44.3 | 57.4 | 39.1 |
| 20 | 8.2 | 9.3 | 63.0 | 45.8 | 57.0 | 42.8 | 54.8 | 36.5 |
| 25 | 9.1 | 10.4 | 62.3 | 44.3 | 55.2 | 41.3 | 53.1 | 33.9 |
| 31.25 | 10.3 | 11.7 | 59.0 | 42.9 | 50.2 | 39.9 | 48.7 | 31.2 |
| 62.5 | 14.9 | 17.0 | 56.1 | 38.4 | 49.6 | 35.4 | 41.2 | 21.4 |
| 100 | 19.3 | 22.0 | 49.0 | 35.3 | 41.8 | 32.3 | 29.7 | 13.3 |

-continued

| Frequency | PSACR (dB/100 m) | | ELFEXT (dB/100 m) | | PSELFEXT (dB/100 m) | | RL (dB) |
|---|---|---|---|---|---|---|---|
| (MHz) | Typical | Maximum | Typical | Minimum | Typical | Minimum | Minimum |
| 0.772 | 78.4 | 62.2 | 87.1 | 66.0 | 83.6 | 63.0 | — |
| 1 | 74.3 | 60.3 | 80.9 | 63.8 | 78.7 | 60.8 | 20.0 |
| 4 | 66.5 | 49.2 | 72.3 | 51.7 | 68.8 | 48.7 | 23.0 |
| 8 | 56.3 | 43.0 | 64.4 | 45.7 | 63.5 | 42.7 | 24.5 |
| 10 | 54.0 | 40.8 | 62.5 | 43.8 | 61.8 | 40.8 | 25.0 |
| 16 | 50.9 | 36.1 | 61.2 | 39.7 | 57.5 | 36.7 | 25.0 |
| 20 | 48.8 | 33.5 | 61.2 | 37.7 | 54.6 | 34.7 | 25.0 |
| 25 | 46.0 | 30.9 | 60.0 | 35.8 | 54.6 | 32.8 | 24.3 |
| 31.25 | 39.8 | 28.2 | 55.5 | 33.9 | 51.6 | 30.9 | 23.6 |
| 62.5 | 34.6 | 18.4 | 47.5 | 27.8 | 44.2 | 24.8 | 21.5 |
| 100 | 22.5 | 10.3 | 35.6 | 23.8 | 38.8 | 20.8 | 20.1 |

| | |
|---|---|
| DC Resistance: | 9.38 Ω/100 m (28.6 Ω/Mft) Maximum |
| DCR Unbalanced: | 5% Maximum |
| Mutual Capacitance: | 55.8 pF/m (17 pF/ft) Maximum |
| Capacitance Unbalanced: | 330 pF/100 m (1 pF/ft) Maximum |
| Characteristic Impedance: | 100 Ω ± 15% (1-100 MHz) |
| Input Impedance: | 100 Ω ± 15% (1-100 MHz) |
| Prop. Delay (Skew): | 45 ns/100 m Maximum |
| Velocity of Propagation: | 69% Nominal |
| Temperature Rating: | −20° C. to +75° C. |
| Voltage Rating: | 300 V Maximum |

A method of manufacturing a data cable begins with providing conductors 102. The method of manufacturing is described as being performed in a particular order to simplify the description of the method. However, the order in which these operations are performed is not important, and another order can work. In the embodiment shown, the conductors 102 are 24 AWG and made of copper. The conductors 102 are then pulled through a foam and insulation extruder. The foam and insulation extruder places insulation substantially around each conductor 102 and the foam 104 substantially around the insulation. The insulation may be colored, coded, marked, or otherwise processed to provide identification. Then, a solid coating 106 is placed substantially around the foam 104. In the embodiment shown, pairs of the conductors 102 are twisted together. The twisting lay can be between approximately one-half inch to approximately one inch. Next, the conductors 102 which are substantially surrounded by the foam 104 and the solid coating 106 are placed in the filler material 108. Corewrap 114 made of mylar contains the filler material 108 while the conductors 102 are being placed in the filler material 108. Then, the shielding member 116 is placed substantially around the corewrap 114. In the embodiment shown, aluminum and mylar tape is pulled substantially around the filler compound 108 and then a copper braid is weaved substantially around the aluminum and mylar tape. Next, the water swellable tape 118 is disposed substantially over the shielding member 116. Finally, the jacket 120 is placed substantially around the water swellable tape 118. In the embodiment shown, the jacket 120 is extruded around the water swellable tape 118. If the jacket 120 is made of a material containing cross link agents, then the data cable 100 undergoes cross linking, which can be completed by electron beam exposure.

As is apparent from the above description, the invention provides a data cable 100 that is capable of blocking water while substantially maintaining transmission properties. The data cable 100 has water blocking protection that includes water swellable materials, but the water swellable materials are isolated and separated from the conductors 102 of the data cable. Because the water swellable materials are isolated and separated from the conductors 102 of the data cable 100, expansion of the water swellable materials does not substantially affect the transmission properties of the data cable 100. Also, the data cable 100 substantially meets or exceeds the requirements of MIL-DTL-24643/59, which specifies the requirements for water blocking data cable used aboard Navy ships.

While a particular embodiment has been chosen to illustrate the invention, it will be understood by those skilled in the art that various changes and modifications can be made therein without departing from the scope of the invention as defined in the appended claims.

What is claimed is:

1. A cable comprising:

a plurality of conductors; and a filler material substantially surrounding the plurality of conductors, the filler material including a foam filler and a water blocking material, said foam filler makes up a substantially greater percentage of said filler material than said water blocking material such that the electrical transmission properties of said conductors are optimized while blocking water from said conductors, wherein the plurality of conductors are embedded in the filler material.

2. A cable according to claim 1, wherein the foam filler is made of high density polyethylene (HDPE).

3. A cable according to claim 1, further comprising:

an insulation substantially surrounding each of the plurality of conductors, the insulations being embedded in the filler material.

4. A cable according to claim 1, further comprising:

a foam disposed substantially surrounding each of the plurality of conductors, the foam being embedded in the filler material.

5. A cable according to claim 4, wherein the foam is made of high density polyethylene (HDPE), propylene, thermoplastic polymer, polyvinyl chloride (PVC), polytetrafluoroethylene (PTFE), fluorinated ethylene-propylene (FEP), or perfluoroalkoxy polymer resin (PFA).

6. A cable according to claim 1, further comprising:
a solid coating substantially surrounding each of the plurality of conductors, the solid coatings being embedded in the filler material.

7. A cable according to claim 1, further comprising:
a corewrap substantially surrounding the filler material.

8. A cable according to claim 1, further comprising:
a shielding member substantially surrounding the filler material.

9. A cable according to claim 1, further comprising:
a jacket disposed substantially around the filler material.

10. A cable according to claim 9, wherein
the jacket is made of a fire retardant, substantially halogen free polyolefin with cross link agents.

11. A cable according to claim 1, wherein
the cable is a data cable.

12. A cable according to claim 1, wherein
said foam filler is at least 70% of the filler material.

13. A cable according to claim 12, wherein
the electrical transmission properties of said conductors meet the MIL-DTL-24643 standard.

14. A cable comprising:
a plurality of conductors;
a foam substantially surrounding each of the plurality of conductors;
a solid coating substantially surrounding the foam; and
a filler material within which the plurality of conductors with the foam and the solid coating are embedded, the filler material including a foam filler and a water blocking material, wherein said foam filler makes up a substantially greater percentage of said filler material than said water blocking material such that the electrical transmission properties of said conductors are optimized while blocking water from said conductors.

15. A cable according to claim 14, wherein the foam filler is made of high density polyethylene (HDPE).

16. A cable according to claim 14, wherein the foam is made of high density polyethylene (HDPE), propylene, thermoplastic polymer, polyvinyl chloride (PVC), polytetrafluoroethylene (PTFE), fluorinated ethylene-propylene (FEP), or perfluoroalkoxy polymer resin (PFA).

17. A cable according to claim 14, further comprising:
a corewrap substantially surrounding the filler material.

18. A cable according to claim 14, further comprising:
a shielding member substantially surrounding the filler material.

19. A cable according to claim 14, further comprising:
a jacket disposed substantially around the filler material.

20. A cable according to claim 19, wherein
the jacket is made of a fire retardant, substantially halogen free polyolefin with cross link agents.

21. A cable according to claim 14, wherein
the cable is a data cable.

22. A cable according to claim 14, wherein
said foam filler is at least 70% of the filler material.

23. A cable according to claim 22, wherein
the electrical transmission properties of said conductors meet the MIL-DTL-24643 standard.

24. A method of manufacturing a cable, the method comprising the steps of:
providing a plurality of conductors; and
embedding the plurality of conductors in a filler material with a foam filler and a water blocking material, wherein the foam filler makes up a substantially greater percentage of the filler material than the water blocking material such that the electrical transmission properties of the conductors are optimized while blocking water from the conductors.

25. A method according to claim 24, further comprising the step of
disposing an insulation on each of the plurality of conductors such that the insulations are embedded in the filler material.

26. A method according to claim 24, further comprising the step of
disposing foam substantially on each of the plurality of conductors such that the foam is embedded in the filler material.

27. A method according to claim 24, further comprising the step of
disposing a solid coating substantially on each of the plurality of conductors such that the solid coatings are embedded in the filler material.

28. A method according to claim 24, further comprising the step of
disposing a shielding member substantially around the filler material.

29. A method according to claim 24, further comprising the step of
disposing a water swellable tape substantially around the filler material.

30. A method according to claim 24, further comprising the step of
disposing a jacket substantially around the filler material.

31. A method according to claim 24, further comprising the step of
forming the foam filler from high density polyethylene.

32. A method according to claim 24, further comprising the step of
forming the foam from high density polyethylene (HDPE), propylene, thermoplastic polymer, polyvinyl chloride (PVC), polytetrafluoroethylene (PTFE), fluorinated ethylene-propylene (FEP), or perfluoroalkoxy polymer resin (PFA).

33. A method according to claim 24, further comprising the step of
disposing a corewrap substantially around the filler material.

34. A cable according to claim 24, wherein
the cable is a data cable.

* * * * *